US006729380B2

(12) United States Patent
Whitley et al.

(10) Patent No.: US 6,729,380 B2
(45) **Date of Patent: *May 4, 2004**

(54) GUIDE MEMBER SILENCERS FOR TRACK GUIDED DOORS

(75) Inventors: L. Blake Whitley, Arlington, TX (US); David M. Wells, Arlington, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/162,269

(22) Filed: Jun. 3, 2002

(65) Prior Publication Data

US 2003/0221802 A1 Dec. 4, 2003

(51) Int. Cl.[7] ..... E06B 15/16
(52) U.S. Cl. ..... 160/201; 16/DIG. 6; 267/228
(58) Field of Search ..... 160/201; 16/91, 16/97, 35 D, DIG. 6; 193/37, 35 B; 267/158, 228

(56) References Cited

U.S. PATENT DOCUMENTS

| | | | | |
|---|---|---|---|---|
| 2,616,755 A | * | 11/1952 | Amato | 49/440 |
| 3,634,907 A | * | 1/1972 | Watt, Jr. | 16/418 |
| 4,205,713 A | | 6/1980 | Galbreath | |
| 4,379,479 A | | 4/1983 | Whiting | |
| 4,572,268 A | | 2/1986 | Wentzel | |
| 4,924,932 A | | 5/1990 | Esnault | |
| 4,979,262 A | * | 12/1990 | Lautenschlager | 16/97 |
| 5,235,724 A | | 8/1993 | Perrin et al. | |
| 5,566,740 A | | 10/1996 | Mullet et al. | |
| 5,613,265 A | * | 3/1997 | Gemmell | 15/230.11 |
| 5,645,155 A | * | 7/1997 | Houghton | 193/35 R |
| 5,678,280 A | * | 10/1997 | Haab et al. | 16/87.6 R |
| 5,992,497 A | * | 11/1999 | Jaehnen et al. | 160/201 |
| 6,185,783 B1 | | 2/2001 | Carpinella | |

* cited by examiner

*Primary Examiner*—Blair M. Johnson
(74) *Attorney, Agent, or Firm*—Gardere Wynne Sewell, LLP

(57) ABSTRACT

Track guided doors, such as upward acting multipanel garage doors are provided with roller guide member support brackets on opposite side edges of the panels for supporting guide rollers disposed in the opposed guide tracks. The support brackets include bearing bores formed by bore walls of the support brackets for supporting elongated stem or shaft portions of the roller guide members. The roller guide members may include leaf springs mounted in grooves on the guide member shaft portions or the support bracket may include elastically deflectable clips mounted thereon, the leaf springs and clips providing resilient members for engagement with the stem parts, respectively, to bias them into engagement with the bore walls of the support brackets to minimize noise generated by the guide members during movement of the door.

19 Claims, 5 Drawing Sheets

GUIDE MEMBER SILENCERS FOR TRACK GUIDED DOORS

BACKGROUND

In the development of track guided doors, such as upward acting residential and commercial garage doors, there is an ever present need to provide for quiet operation when moving the door between open and closed positions.

One source of objectionable noise generated by track guided doors pertains to the guide members which are connected to the door section or sections, are disposed in opposed guide tracks and guide and support the door for movement between open and closed positions. Conventional upward acting garage doors, for example, utilize guide members which include elongated stems or shafts disposed in support members mounted on the door panels, which support members are typically configured to provide bearing bores for the guide member stems or shafts. Guide member stems or shafts made of metal, in particular, and residing in formed metal support members or so-called roller brackets are particularly capable of generating noise when the door is moving between open and closed positions, and to some extent when the door is stationary and is subject to moderate vibrations generated by windloads and the like.

Accordingly, there has been a need to provide for reducing the noise generated by track guided door guide members and it is to these ends that the present invention has been developed.

SUMMARY OF THE INVENTION

The present invention provides an improved track guided door which includes opposed sets of guide members for guiding the door for movement between open and closed positions within opposed guidetracks and wherein the guide members are supported for substantially reduced acoustic emissions.

The present invention also provides guide members with improved support stems or shafts for use with track guided doors wherein noise generated by the guide members and their support structure is substantially reduced or eliminated.

In accordance with one aspect of the present invention, guide members for track guided doors are provided with support shafts or stems which include means to retain the shafts or stems snugly fitted in bearing bores formed by guide member support parts mounted on the door panel or panels. In particular, the guide member stems or shafts are provided with one or more axially extending grooves circumferentially spaced apart and adapted to receive and support elongated leaf type springs which engage the wall of the bearing bore in which the stems are supported to bias the stems into engagement with the bore wall and reduce or eliminate noise generated by loosely fitted stems.

In accordance with another aspect of the invention, guide members for track guided doors are provided which include plural circumferentially spaced noise reducing members mounted on the guide member support stems or shafts and are operable to prevent the noise reducing members from lodging in grooves formed in guide member support structure.

In accordance with another aspect of the present invention, guide member noise reducing or silencing devices are provided which are mounted on the guide member support brackets and provide projections which protrude into the support bracket bearing bores for biasing the guide member support stems or shafts into forcible engagement with the respective bearing bore walls to reduce noise generated by and between the support brackets and the guide member support stems.

Those skilled in the art will further appreciate the above-mentioned features of the present invention, together with other important aspects thereof upon reading the detailed description which follows in conjunction with the drawings.

DETAILED DESCRIPTION OF PREFERRED EMBODIMENTS

Figure 1:
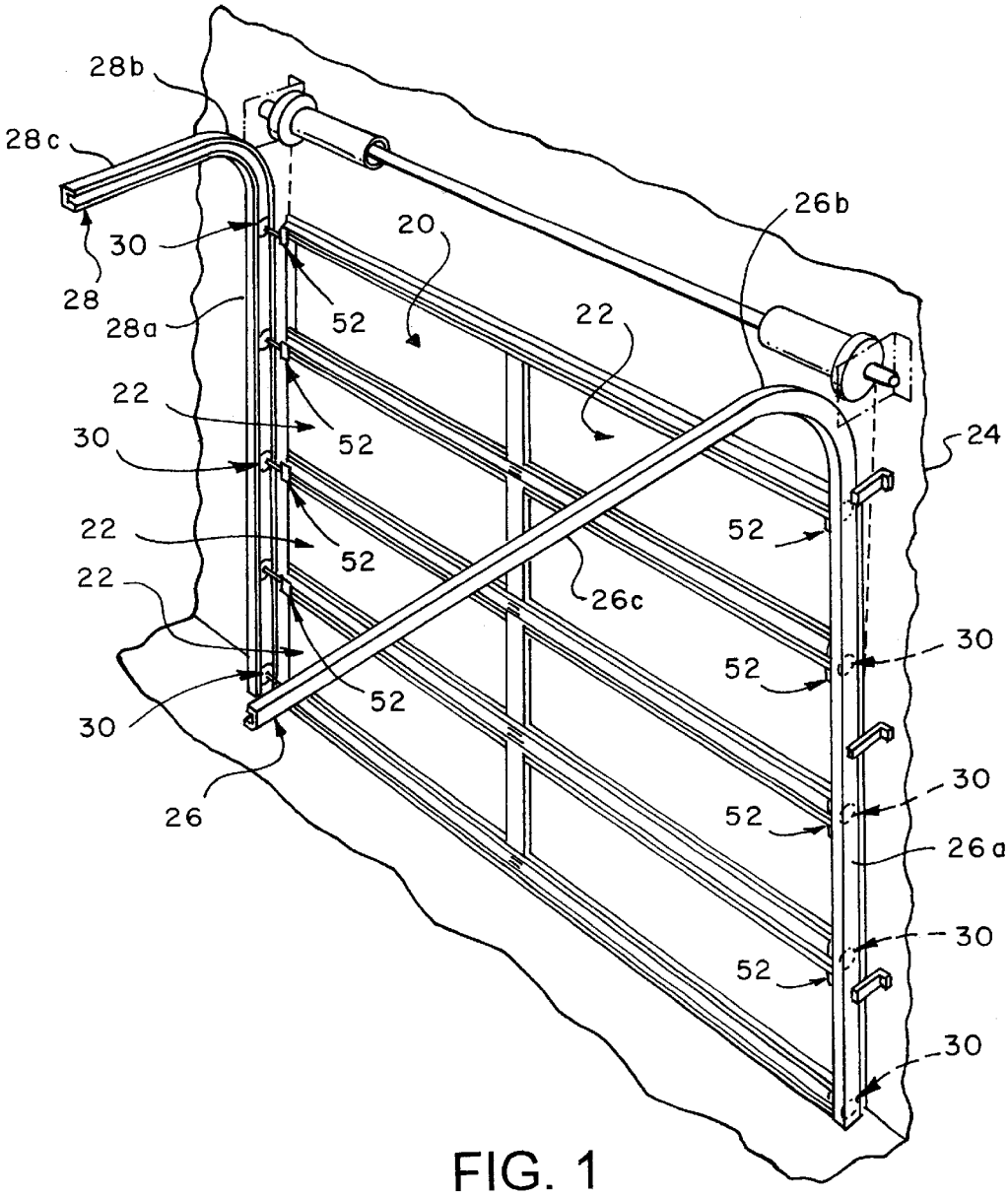
FIG. 1 is a perspective view of a sectional track guided door which includes guide members in accordance with the invention.

In the description which follows like parts are marked throughout the specification and drawings with the same reference numerals, respectively. The drawing figures are not necessarily to scale in the interest of clarity and conciseness.

Referring to FIG. 1, there is illustrated a conventional, except for the improvement of the present invention, upward acting sectional garage door, generally designated by the numeral 20. The door 20 is characterized by plural hingedly connected panels 22 which are guided for movement between the closed position shown, adjacent a vertical wall 24, and an open position by opposed guide track assemblies 26 and 28. The guide track assemblies 26 and 28 may be of conventional construction or as disclosed in published Patent Application No. US2002/0003031A1, assigned to the assignee of the present invention. The guide track assemblies 26 and 28 are formed of somewhat channel shaped members including generally vertically extending track sections 26*a* and 28*a*, curvilinear transition sections 26*b* and 28*b* and generally horizontal linear sections 26*c* and 28*c*. The panels 22 are supported for movement between door open and closed positions by opposed sets of guide members, each generally designated by the numeral 30. Each guide member 30 is disposed in one of the track assemblies 26 or 28 in a generally known manner.

Figure 4:
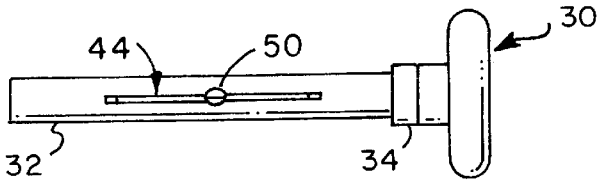
FIG. 4 is an elevation view of one of the guide members for the track guided door shown in FIGS. 1 through 3.
Figure 5:
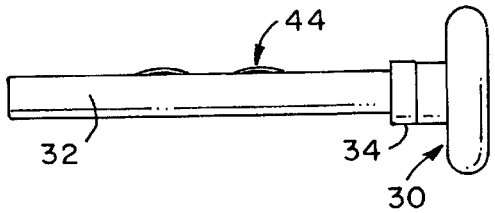
FIG. 5 is another elevation view of the guide member shown in FIG. 4.
Figure 6:
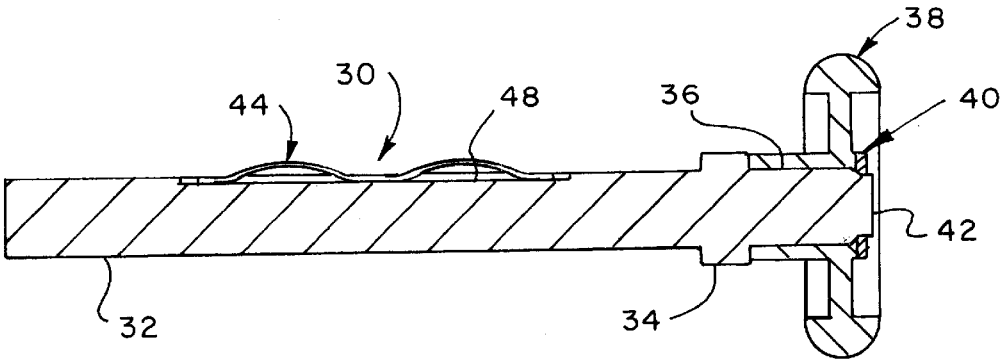
FIG. 6 is a longitudinal central section view of the guide member shown in FIGS. 4 and 5.
Figure 7:
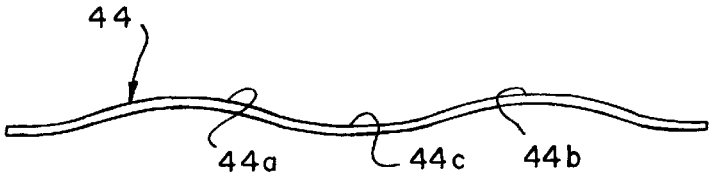
FIG. 7 is a side elevation of a leaf spring used in connection with the guide member shown in FIGS. 4 through 6.
Figure 8:
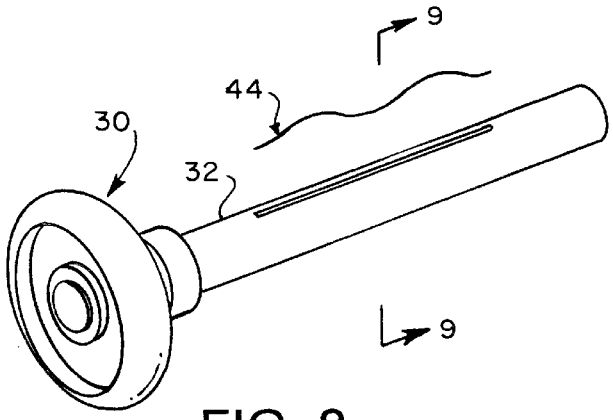
FIG. 8 is an exploded perspective view of the guide member shown in FIGS. 4 through 6.

Referring now to FIGS. 4, 5 and 6, one embodiment of an improved guide member 30 in accordance with the invention is illustrated. The guide member 30 includes an elongated shaft or stem part 32 of generally cylindrical cross section, see FIGS. 8 and 9 also. Stem part 32 includes a circumferential integral collar 34 and a roller axle portion 36, FIG. 6, on which is rotatably disposed a roller member 38 for rotation relative to the stem part 32. The roller 38 is preferably retained on the axle portion 36 by a suitable retaining ring 40. Additionally, the distal end 42 of the stem part 36 may be staked to retain the retaining ring 40 thereon.

Figure 9:
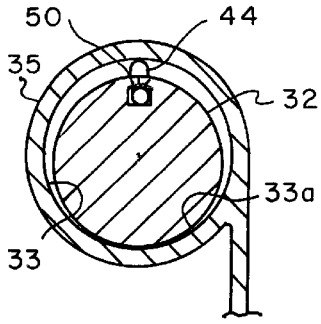
FIG. 9 is a section view taken generally along line 9—9 of FIG. 8 and showing the guide member stem or shaft disposed in a support member therefor.

The guide member 30 advantageously includes a resilient silencing member, generally designated by the numeral 44, in FIGS. 4 through 7, 8 and 9. The resilient member 44 is preferably characterized as a leaf spring having spaced apart bow portions 44*a* and 44*b* and a generally flat portion 44*c* interposed the bow portions. The resilient leaf spring silencing member 44 preferably also comprises a piece of music wire having a diameter of about 0.024 inches and a length of about 2.00 inches for use with a guide member having a stem part with a diameter of about 0.437 inches, for example. The stem part 32 includes an elongated axial extending groove 48 for receiving the resilient member 44 therein as illustrated in FIG. 6, in particular. The groove 48 is preferably slightly longer than the undeflected length of the resilient member 44 to accommodate deflection and the resulting linear extension of the bow portions 44*a* and 44*b*. The resilient member 44 is preferably retained in the groove 48 by staking the stem part 32 at location 50, as shown in FIGS. 4 and 9, to plastically deform material of the stem part to retain the member 44 in the groove, since the flat portion 44*c* is in forcible engagement with the staked part 50 of the stem part 32.

By providing a guide member, such as the roller type guide member 30, with a resilient member disposed on the stem part 32, the stem part may be disposed in a bore of a guide member support bracket with a relatively loose fit in the bore since the resilient member 44 will bias the stem part against the bore wall and minimize movement of the stem part with respect to the bore wall and thus substantially eliminate the rattling noise created by guide members which are loosely retained in bearing bores of guide member support brackets and the like and which do not have any type of silencing means. FIG. 9 illustrates the stem part 32 disposed in a bearing bore 33 of a guide member support bracket 35 and biased against the bore wall 33*a* by the resilient member 44.

Figure 2:
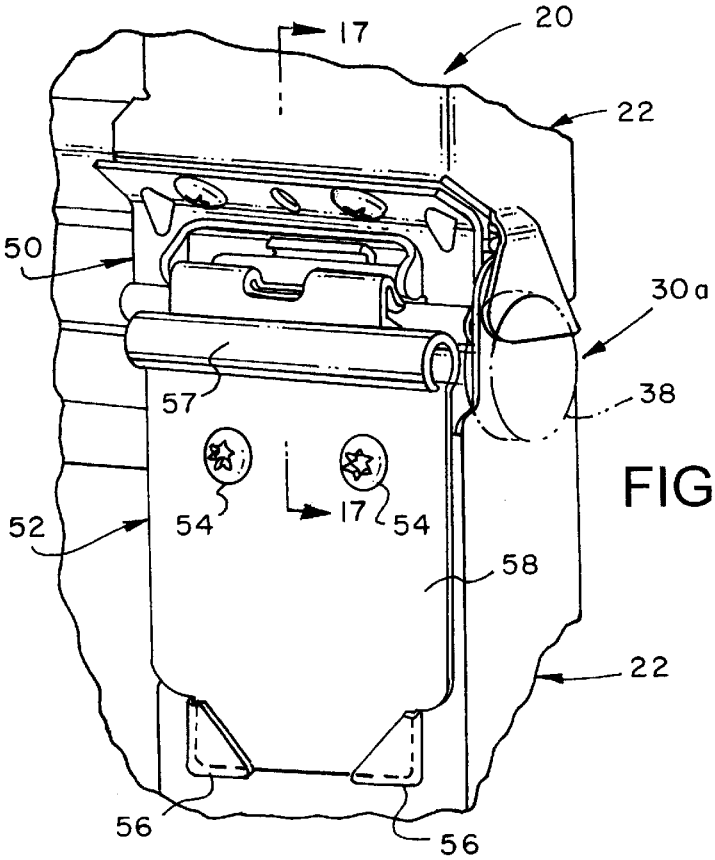
FIG. 2 is a detail perspective view of a portion of the door shown in FIG. 1 and showing a typical guide member and support bracket therefor.

Referring now to FIG. 2, there is illustrated a portion of the door assembly 20, including a hinge assembly 50 for hingedly connecting two adjacent door panels 22 to each other, as illustrated. Further details of the hinge assembly 50 may be obtained by reference to U.S. patent application Ser. No. 09/910,992, filed Jul. 23, 2001 by L. Blake Whitley et al. and assigned to the assignee of the present invention. As further shown in FIG. 2, a guide member support bracket 52 is mounted on one of the panels 22 and retained thereon by suitable fastener means 54 and gussets 56. The guide member support bracket 52 is preferably characterized by a tubular bearing member 57 formed integral with a plate portion 58. The support bracket 52 is also typically fabricated by roll forming a substantially flat plate member to form the tubular portion 57 having a bearing bore defined by a generally cylindrical bore wall 59 and having a distal end 60 leaving a gap 61 between the tubular bearing portion 57 and the plate portion 58. Guide member support brackets so formed are indicated to require a modified guide member which in some ways is substantially like the guide member 30 but includes a modified stem portion.

Figure 17:
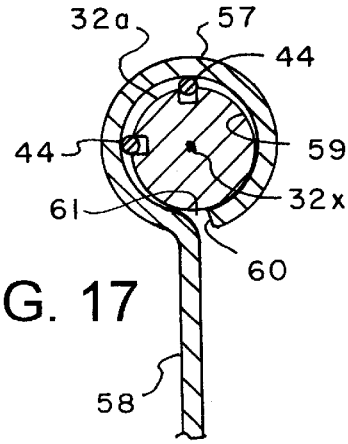
FIG. 17 is a section view taken along the line 17—17 of FIG. 2.
Figure 11:
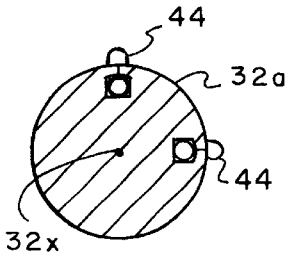
FIG. 11 is a section view taken generally along the line 11—11 of FIG. 10.
Figure 10:
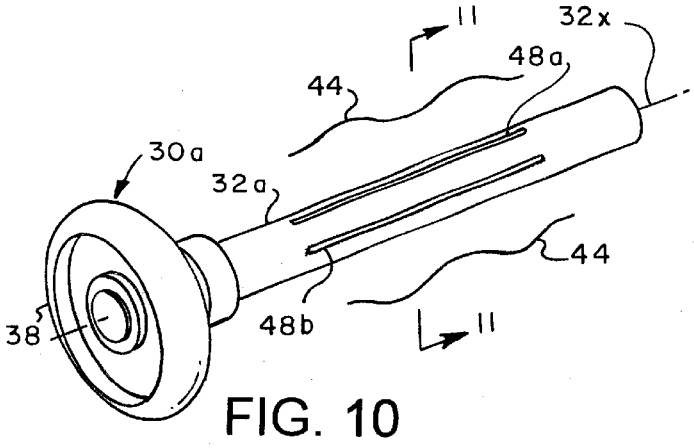
FIG. 10 is an exploded perspective view of a first alternate embodiment of a guide member in accordance with the invention.
Figure 13:
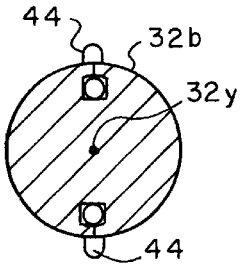
FIG. 13 is a section view taken generally along line 13—13 of FIG. 12.
Figure 12:
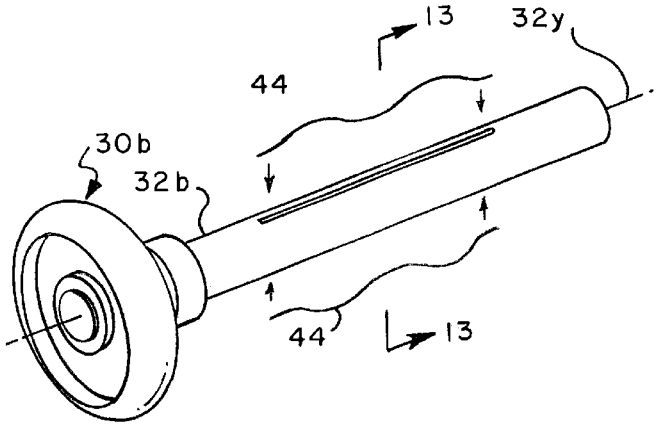
FIG. 12 is an exploded perspective view of a track guided door guide member including another arrangement of the stem silencing springs in accordance with the invention.

Referring briefly to FIGS. 10 and 11, for example, there is illustrated a modified guide member 30*a* having a cylindrical stem portion 32*a* and a roller 38 mounted thereon in the same manner as for the guide member 30. However, the cylindrical stem or shaft member 32*a* is provided with two circumferentially spaced elongated grooves 48*a* and 48*b*, as shown in FIGS. 10, 11 and 17 for receiving resilient leaf spring members 44 in the same manner as for the guide member 30. The resilient members 44 are retained in the slots 48*a* and 48*b* in the same manner as for the guide member 30. As shown in FIG. 17, by providing more than one resilient member circumferentially spaced from another resilient member, there is no risk of both resilient members registering with the gap 61 to thereby negate the function of these members. The degree of circumferential spacing of the resilient leaf spring members 44 for the guide member 30*a* is illustrated to be about 90 degrees with respect to a longitudinal central axis 32*x* for the stem part 32. Different angular spacings of the resilient members 44 may be provided. For example, referring briefly to FIGS. 12 and 13, there is illustrated another embodiment of a guide member 30*b* having a cylindrical stem part 32*b* with a roller 38 mounted thereon. The stem part 32*b* is adapted to support two resilient members comprising leaf springs 44 thereon and spaced 180° apart with respect to a longitudinal central axis 32*y* of stem part 32*b*.

Figure 3:
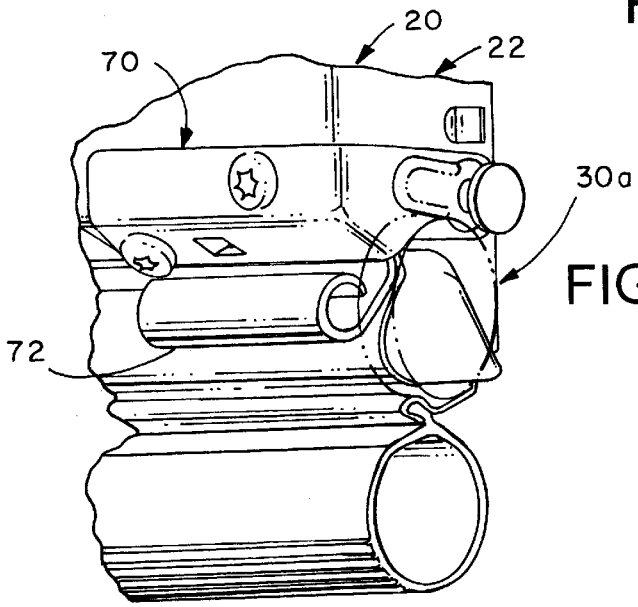
FIG. 3 is a perspective view of a lower portion of the door shown in FIG. 1 and showing another guide member and support bracket therefor.

Referring now to FIG. 3, a part of a lowermost panel 22 for the door 20 is illustrated and which is provided with a suitable bracket 70 including a bearing part 72 for supporting a guide member 30*a* in a manner similar to that provided by the guide member support bracket 52. However, the bracket 70 is also adapted for connection to a counterbalance cable, not shown in FIG. 3, for the door 20. The bracket 70 is further described in co-pending U.S. patent application Ser. No. 09/910,992, referenced hereinabove.

Figure 14:
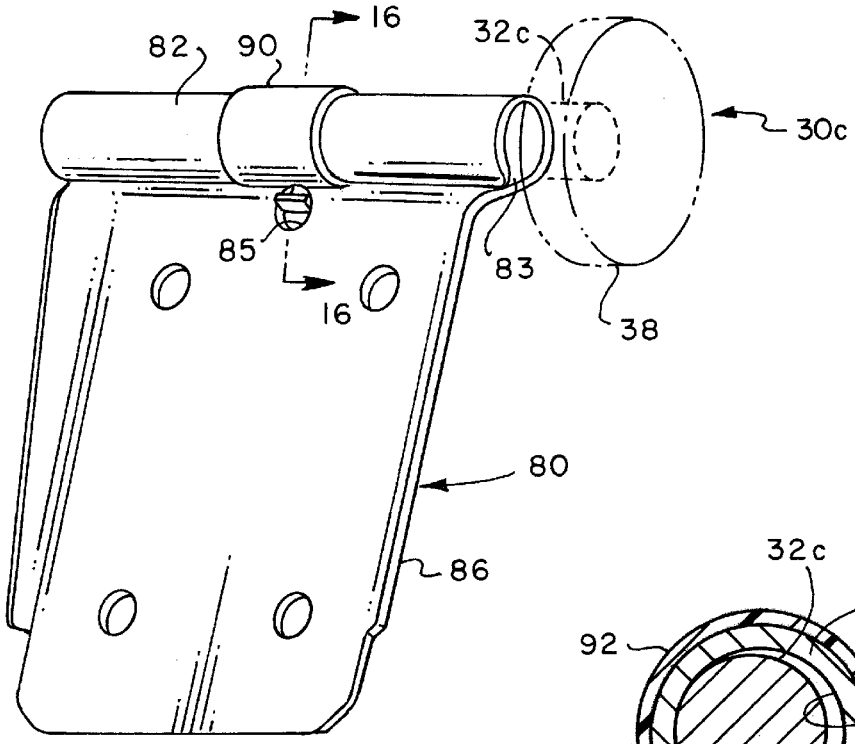
FIG. 14 is a perspective view of a guide member support bracket including a noise reducing or silencing device in accordance with an alternate embodiment of the invention.
Figure 16:
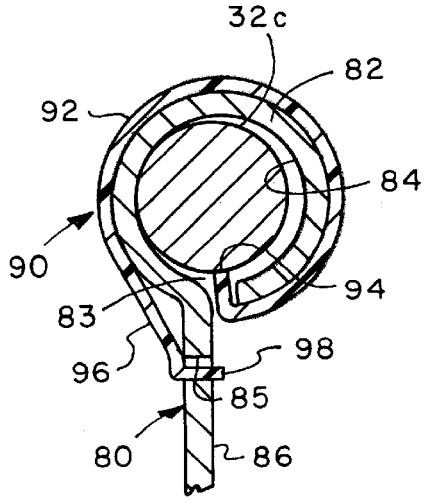
FIG. 16 is a section view taken along the line 16—16 of FIG. 14.
Figure 15:
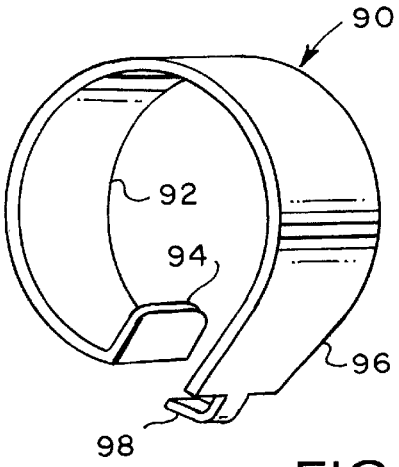
FIG. 15 is a perspective view of the device shown mounted on the guide member support bracket in FIG. 14.

Referring now to FIGS. 14 through 16, another embodiment of a support bracket and guide member stem silencing arrangement in accordance with the invention is illustrated. FIGS. 14 and 16 illustrate a guide member support bracket 80 including a rolled metal member characterized by a generally tubular bearing part 82. Bearing part 82 defines a bearing bore delimited by a bore wall 84, FIG. 16, and which is integrally formed with a plate part 86 similar to the plate part of the bracket 52. The guide member support bracket 80 is also preferably formed in such a way that a gap 83 is formed between the tubular bearing part 82 and the plate part 86 as shown in FIGS. 14 and 16. FIGS. 14 and 16 also illustrate the disposition of a guide member 30*c* having a cylindrical stem part 32*c* supporting a roller 38 thereon in the same manner as for the guide member 30.

However, the stem part 32*c* is not provided with a resilient member to bias the stem part into forcible engagement with the bore wall 84. Accordingly, the guide member 30*c* is a substantially conventional guide member and would be susceptible to vibratory lateral movement within the bearing bore defined by the bore wall 84, except for the provision of a guide member silencer characterized by a substantially cylindrical ring shaped clip member, generally designated by the numeral 90 in FIGS. 14, 15 and 16. The resilient clip silencer member 90 includes a cylindrical ring or band portion 92 which terminates at one end in a radially inwardly projecting tab 94 and terminates at the opposite end in a generally planar tangential part 96 having a retainer hook 98 formed on the distal end thereof, as shown in FIGS. 15 and 16. The resilient guide silencer member 90 is suitably formed of an elastically deformable material such as metal or plastic and the tab 94 is dimensioned such as to project radially inwardly into the bearing bore formed by the bore wall 84 through the gap 83, as illustrated in FIG. 16. The resilient member 90 is also retained on the tubular bearing part 82 of bracket 80 by provision of the hook part 98 projecting through a suitable opening 85 formed in the plate part 86 of the bracket 80. The resilient member 90 may be assembled to the bracket 80 by snapping the tab 94 into the gap 83 and the hook 98 into the opening 85. The member 90 is preferably dimensioned to be at least slightly elastically deformed in the position shown in FIG. 16 so as to enable it to forcibly grip the tubular bearing part 82. Accordingly, the embodiment of the invention shown in FIGS. 14 through 16 is also operable to reduce or eliminate noise generated by movement of a guide member stem or shaft within its support bracket receiving bore.

The construction and use of the embodiments of the invention disclosed hereinbefore is believed to be readily understandable to those of ordinary skill in the art based on the foregoing description. Conventional engineering materials may be used to fabricate the elements of the guide members and associated support structure as well as the resilient members usable with the guide members as described hereinbefore.

Although preferred embodiments of the invention have been described in detail, those skilled in the art will recognize that various substitutions and modifications may be made without departing from the scope and spirit of the appended claims.

What is claimed is:

1. A track guided door adapted for movement between open and closed positions guided by opposed guide tracks, said door including at least one door panel and guide member supports on said at least one door panel, said supports each including a bearing bore forming a bore wall, spaced apart guide members for said door operable to be engaged with said guide tracks, respectively, said guide members each including an elongated stem part disposed in a bearing bore of one of said supports, respectively, and a resilient member interposed said stem part and said bore wall and operable to bias said stem part into engagement with said bore wall to minimize noise during movement of said door.

2. The door set forth in claim 1 wherein:

said door includes plural door panels and guide member supports on at least selected ones of said panels and on opposite sides of said panels for supporting guide members in said opposed guide tracks, respectively, each of said guide members including a stem part and a resilient member operable to bias said stem part against said bore wall of an associated support, respectively.

3. The door set forth in claim 1 wherein:

said resilient member is mounted on said stem part.

4. The door set forth in claim 3 wherein:

said stem part includes plural resilient members mounted thereon and spaced apart.

5. The door set forth in claim 4 wherein;

said resilient members are circumferentially spaced apart about a central axis of said stem part.

6. The door set forth in claim 1 wherein:

said resilient member comprises a spring.

7. The invention set forth in claim 6 wherein:

said resilient member comprises an elongated leaf spring.

8. The door set forth in claim 7 wherein:

said spring includes a wire member including at least one bowed portion supported on said stem part for engagement with said bore wall.

9. The door set forth in claim 8 wherein:

said stem part includes an elongated groove formed therein and said spring is supported on said stem part in said groove.

10. The door set forth in claim 9 wherein:

said spring is retained in said groove by displacing material of said stem part to deform a part of said groove.

11. The door set forth in claim 1 wherein:

said guide members comprise rollers mounted on one end of said stem part and adapted to be disposed in engagement with said guide tracks, respectively.

12. A track guided door adapted for movement between open and closed positions guided by opposed guide tracks, said door including at least one door panel and guide member support brackets on said at least one door panel, said support brackets each including a bearing bore formed by a bore wall, guide members for said door operable to be engaged with said guide tracks, respectively, said guide members each including an elongated stem part disposed in a bearing bore of one of said support brackets, respectively; and plural biasing members mounted on said stem part circumferentially spaced apart about a central axis of said stem part and operable to bias said stem part into engagement with said bore wall to minimize noise generated by said guide members during movement of said door.

13. The door set forth in claim 12 wherein:

said biasing members comprise springs.

14. The door set forth in claim 13 wherein:

said springs each comprise a spring wire member including at least one bowed portion supported on said stem part for engagement with said bore wall.

15. The door set forth in claim 12 wherein:

said biasing members are spaced apart less than about 180° with respect to said central axis.

16. The door set forth in claim 12 wherein:

said biasing members are retained in grooves formed in said stem part, respectively.

17. In a track guided door adapted for movement between open and closed positions guided by at least one guide track, said door including at least one door panel and opposed guide member support brackets on said at least one door panel, said support brackets each including a bearing bore forming a bore wall, guide members for said door operable to be engaged with said guide tracks, respectively, said guide members each including an elongated stem part disposed in a bearing bore of a support bracket, respectively, the improvement comprising:

a noise reducing member supported on each said support bracket projecting through a gap in said bore wall and forcibly engaged with said stem part for biasing said stem part into engagement with said bore wall to minimize noise generated by said guide members during movement of said door.

18. The invention set forth in claim 17 wherein:

said noise reducing members comprise clips mountable on said support brackets, respectively, and each including a tab part projecting through said gap.

19. The invention set forth in claim 18 wherein:

said clips each include an arcuate portion including a hook on one end and a portion including said tab part formed on an opposite end, said clips being formed of an elastic material operable to provide for elastic deflection of said tab parts in response to engagement with said stem parts of said guide members, respectively.

* * * * *